US008973499B2

(12) United States Patent
Klüpfel et al.

(10) Patent No.: US 8,973,499 B2
(45) Date of Patent: Mar. 10, 2015

(54) APPARATUS FOR OPERATING A PRINTING PRESS WITH A PLURALITY OF OPERATING ZONES, PRINTING PRESS AND MACHINE HAVING THE APPARATUS AND METHOD FOR SAFELY OPERATING A MACHINE

(75) Inventors: Martin Klüpfel, Hockenheim (DE); Manfred Miessl, Bammental (DE); Frank Soltwedel, Sinsheim/Hoffenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 2146 days.

(21) Appl. No.: 11/937,152

(22) Filed: Nov. 8, 2007

(65) Prior Publication Data

US 2008/0107464 A1 May 8, 2008

(30) Foreign Application Priority Data

Nov. 8, 2006 (DE) ..... 10 2006 052 646

(51) Int. Cl.
*B41F 33/00* (2006.01)

(52) U.S. Cl.
CPC ..... *B41F 33/0009* (2013.01); *B41P 2233/20* (2013.01)
USPC ..... 101/484; 340/12.22; 340/12.27

(58) Field of Classification Search
USPC ..... 101/484, DIG. 47; 340/12.22, 12.24, 340/12.27, 15.51
See application file for complete search history.

(56) References Cited

U.S. PATENT DOCUMENTS

| | | | |
|---|---|---|---|
| 4,812,842 | A | 3/1989 | Bayerlein et al. |
| 5,772,195 | A | 6/1998 | Mueller |
| 6,065,333 | A | 5/2000 | Aschmann et al. |
| 6,919,818 | B2 | 7/2005 | Jäggi |
| 2003/0161906 | A1 | 8/2003 | Braunhardt et al. |
| 2006/0213383 | A1 | 9/2006 | Schneider |

FOREIGN PATENT DOCUMENTS

| | | | |
|---|---|---|---|
| DE | 3614744 | A1 | 11/1987 |
| DE | 4306098 | A1 | 9/1994 |
| DE | 29716311 | U1 | 12/1997 |
| DE | 29918654 | U1 | 12/1999 |
| DE | 10203653 | A1 | 7/2003 |
| DE | 10311284 | A1 | 9/2004 |
| EP | 0761472 | A1 | 3/1997 |
| EP | 1247656 | A1 | 10/2002 |
| EP | 1681581 | A1 | 7/2006 |

(Continued)

OTHER PUBLICATIONS

European Search Report dated Nov. 25, 2010.

*Primary Examiner* — Matthew G Marini
(74) *Attorney, Agent, or Firm* — Laurence A. Greenberg; Werner H. Stemer; Ralph E. Locher

(57) ABSTRACT

An apparatus includes a mobile control device for safe operation of machines for processing printing materials. The machine is divided into a plurality of spatially delimited zones and the position of the control device can be detected in relation to the plurality of zones. It is possible to determine the zone in which the control device is located by using the position of the control device. Certain functions of the machine are enabled or disabled depending on the determined zone. A printing press having the device and a method for safely operating a machine for processing printing materials, are also provided.

21 Claims, 1 Drawing Sheet

(56) References Cited

FOREIGN PATENT DOCUMENTS

| | | | | |
|---|---|---|---|---|
| EP | 2061661 | A1 | | 5/2009 |
| GB | 2275444 | A | | 8/1994 |
| GB | 2355432 | A | * | 4/2001 |
| WO | 2008028738 | A1 | | 3/2008 |

* cited by examiner

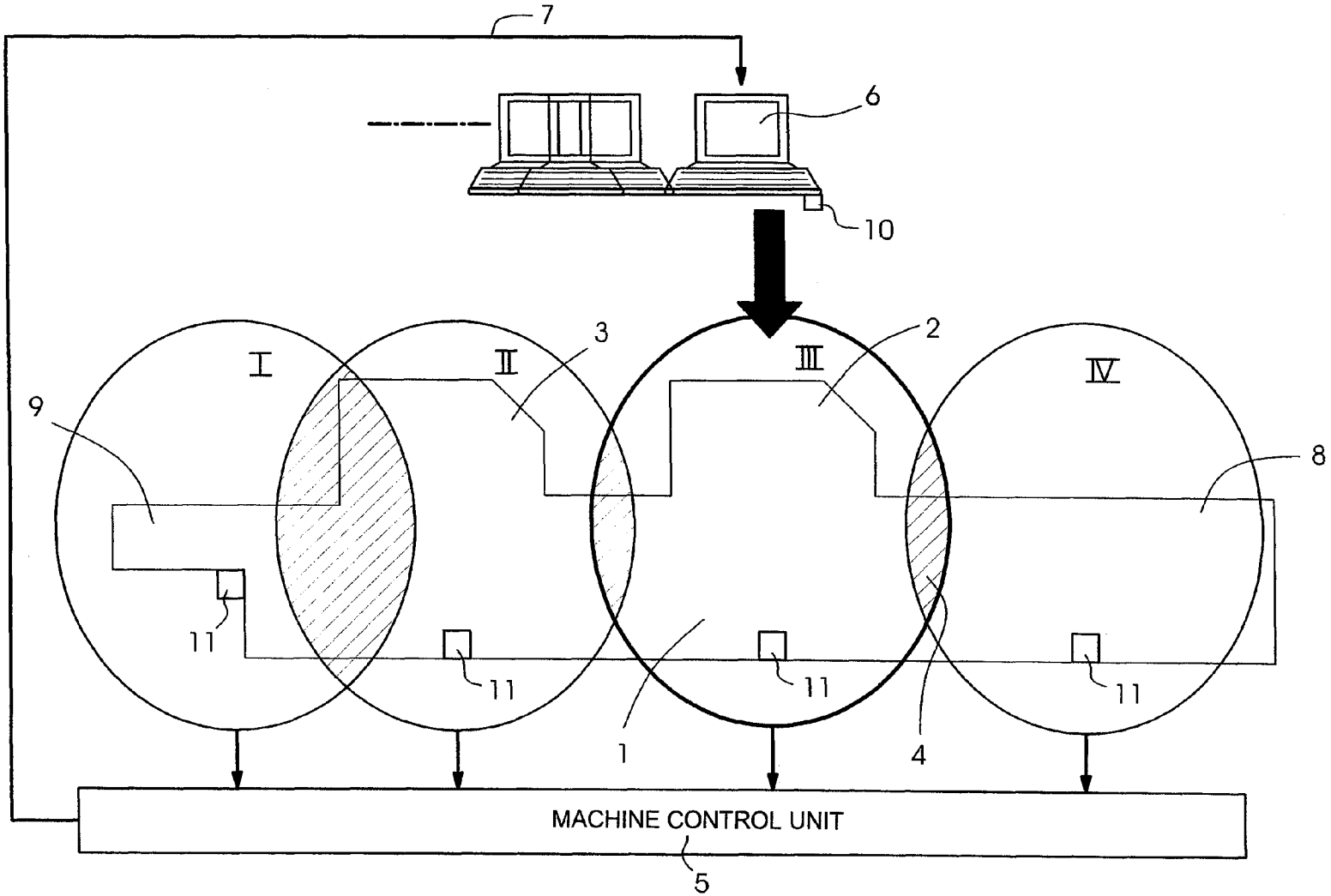
MACHINE CONTROL UNIT
I
II
III
IV
1
2
3
4
5
6
7
8
9
10
11

APPARATUS FOR OPERATING A PRINTING PRESS WITH A PLURALITY OF OPERATING ZONES, PRINTING PRESS AND MACHINE HAVING THE APPARATUS AND METHOD FOR SAFELY OPERATING A MACHINE

CROSS-REFERENCE TO RELATED APPLICATION

This application claims the priority, under 35 U.S.C. §119, of German Patent Application DE 10 2006 052 646.5, filed Nov. 8, 2006; the prior application is herewith incorporated by reference in its entirety.

BACKGROUND OF THE INVENTION

Field of the Invention

The present invention relates to an apparatus with a mobile control device for safe operation of machines which process printing materials and have a plurality of operating zones. The invention also relates to a printing press and a machine having the apparatus as well as a method for safely operating a machine.

Machines which process printing materials such as e.g. printing presses, saddle stitchers and folding machines, have a multiplicity of functions which are usually to be operated through an operating console by a user. For example, the majority of functions of a printing press are monitored with the operating console. However, a rigidly installed stationary operating console has the disadvantage that, in the case of larger machines, the operator cannot simultaneously keep in view the operating console and the region of the machine on which his or her operating commands are being carried out. That relates, in particular, to printing presses in which all of the printing units as well as the feeder region and the delivery region can often not be seen from the operating console. For that reason, in the case of larger printing presses, in particular with a large number of printing units, a plurality of operating consoles are provided. For example, in each case at least one smaller operating panel can be mounted e.g. at each printing unit and in particular at the feeder or delivery of a sheet-fed rotary printing press. Local functions can then be operated in situ with those operating panels at the individual assemblies, such as printing units, feeders and deliveries, so that the operator has the assembly he or she is operating at the time in front of him or her. However, that leads to a larger number of operating consoles, which involves corresponding costs.

A system for the production of print products is known from European Patent EP 1 247 656 B1, corresponding to U.S. Pat. No. 6,919,818, in which a plurality of machines can be actuated by a portable input device through a wireless connection. In that case, the input device can be taken by the operator with him or her to the machine where setting processes, corrections, etc. should be performed at the time. The input device can be a mobile telephone, a PDA or a similar communication device having a position in relation to the individual machines which can be identified by the control unit of the system. For that purpose, the input device has a code carrier and each of the operable machines has a code reader. As soon as the operator approaches a machine with the input device, the code reader of the corresponding machine identifies the presence of the input device and reports the take-up of contact to the machine control unit. The input device can also be constructed in such a manner that the operator must first carry out an authentication. Action permissions can then be enabled in relation to individual machines as a function of that identification.

The above-described procedure is configured for a system with a plurality of machines, in which it is possible to identify the position of the input device relative to a machine, but no precautions are taken to prevent the operation of machines if the remote control is so far from them that the operator cannot view the relevant machine. In the case of printing presses, however, that assignment is insufficient when a mobile operating console should be assigned to a specific part of the printing press. That is necessary for reasons of safety, particularly in the region of the feeder and the delivery, since there is always the risk there that the operator can reach into regions which have a high level of potential risk. For example, in the case of stack movements in the feeder or delivery, it must be ensured that the operator does not remain in that region.

BRIEF SUMMARY OF THE INVENTION

It is accordingly an object of the invention to provide an apparatus for operating a mobile control device for machines which process printing materials and which have a plurality of operating zones, a printing press and a machine having the apparatus, as well as a method for safely operating a machine, which overcome the hereinafore-mentioned disadvantages of the heretofore-known apparatuses and methods of this general type and which improve safety and ease-of-use during operation of a printing press.

With the foregoing and other objects in view there is provided, in accordance with the invention, an apparatus for safely operating machinery. The apparatus comprises a machine divided into a plurality of spatially delimited zones for processing printing materials, and a mobile control device having a position to be detected relative to the plurality of zones, for determining a zone in which the control device is located by using the position of the control device, and enabling or disabling specific functions of the machine for processing printing materials in dependence on the determined zone.

Due to the division of the machine for processing printing materials into a plurality of zones in a spatially delimited manner, on one hand, particularly dangerous regions for the operator such as the feeder and the delivery can be specifically assigned to individual zones in which safety-relevant operating functions can only be performed when the operator remains in the relevant spatially narrowly delimited zone and, on the other hand, no body parts thereof protrude into dangerous regions. To this end, the position of the mobile control device of the operators is detected in relation to the plurality zones so that the control device always knows the zone in which the control device is located at the time. The operator must therefore always remain in the zone in which he or she would like to trigger functions on the machine for processing printing materials at the time. He or she is therefore forced to keep the relevant zone in view. Specific functions of a machine for processing printing materials are enabled or disabled depending on the zone determined by the machine control unit. To this end, it is important that it is clearly determined whether the operating device is positioned inside or outside a zone. This can e.g. be performed by determining the distance of the operating device form a plurality of receivers at the machine. In particular, it can be provided that the operating functions are disabled for all zones in which the operator with the mobile control device is not currently present. The mobile control device can be a remote control in the form of a portable touchscreen operating console, but portable computers programmed with corresponding operating software such as notebook computers, PDAs or even mobile telephones, can also be used. The present invention thus ensures that an operation of functions on a machine are only possible when the operator with the mobile operating console remains in the immediate vicinity of the functions to be operated. This is achieved by the clear spatial division of the entire machine into a plurality of zones.

In accordance with another feature of the invention, the control device includes an electronic transmitter. This transmitter must continuously emit a corresponding signal so that the distance of the mobile control device form a corresponding zone of the machine for processing printing materials can be determined e.g. through the use of its signal strength or signal delay. This occurs in cooperation with one or more electronic receivers which are installed in the machine for processing printing materials and receive the signals of the electronic transmitter of the remote control. During the interaction between the transmitter and receivers, the position of the mobile control device can then be calculated and supplied as a signal to the machine control unit of the machine for processing printing materials. The machine control unit then enables the functions of the relevant zone.

In accordance with a further feature of the invention, the machine for processing printing materials is a printing press with a plurality of printing units, in which one zone is assigned to each printing unit. In the case of this embodiment, a unique assignment of the mobile control device to a printing unit of a printing press is possible. In this case, a zone respectively includes a printing unit so as to prevent the ability of functions on neighboring printing units from being operated from the mobile control device.

In accordance with an added feature of the invention, the machine for processing the printing materials is a printing press with a plurality of printing units, and a plurality of the printing units is brought together in one zone. In the case of such an embodiment of the invention, e.g. groups of printing units can be formed so that, in the case of a long machine with e.g. 16 printing units, 2 or 4 respective printing units are always brought together into one group in one zone. However, it is also possible to divide e.g. the printing units respectively upstream and downstream of the perfecting device of a perfecting press into separate zones so that the printing press includes zones with only one printing unit and zones which include a plurality of printing units. The division into zones can be made dependent on the functionalities of the respective printing units or even on the dangerousness of the device at the printing units. For some time, there have been e.g. attachments for printing units for cold foil embossing on printing materials. Those attachments are usually positioned on the last printing unit or units or on coating units. In this case, it is expedient to provide this last printing unit or coating unit or the last printing units or coating units with a separate zone, in which case the division can be configured flexibly so that the division into a separate zone is only present when the cold foil embossing device is actually positioned above the corresponding printing unit or coating unit. The presence of the cold foil embossing device can be correspondingly detected by contacts or a combination of receiver and transmitter in the printing unit and the cold foil embossing device. Should the device be present, the corresponding printing units are separated from the other printing units and brought together into a separate zone. Should the cold foil embossing device not be in operation, the corresponding printing units or coating units can, like all of the other printing units, also be divided into individual zones or brought together into their respective printing unit group as a common zone.

In accordance with an additional feature of the invention, the printing press includes a delivery and a feeder which are respectively assigned to a separate zone. The particularly dangerous regions of a sheet-fed rotary printing press are thus assigned separate zones. The stay of the operator with the mobile control device in these particularly dangerous regions can thus be made particularly safe.

In accordance with yet another feature of the invention, the mobile control device is a portable computer with a data radio module. Portable computers such as notebooks or PDAs today generally have radio modules for making contact with wireless networks such as W-LAN or radio modules such as Bluetooth for communication with other electronic devices. These radio modules can be used to determine the presence of such a portable computer in a zone. This can be determined e.g. through the delay calculation of the corresponding data connection or through the signal strength which arrives at the receiver of the printing press.

In accordance with yet a further feature of the invention, the portable computer can include an additional RFID chip for identification. These RFID chips have a limited range and also enable a unique identification of the portable device. The range can be set in such a way that it does not extend beyond the intended zonal regions.

In accordance with yet an added feature of the invention, the zones at least partially overlap. In the overlapping regions, an operation of two or a plurality of sub-regions of a machine for processing printing materials is possible, in principle. In normal cases, only the zones of neighboring printing units will overlap so that, in an overlapping region, the neighboring printing unit can also be monitored from the operating panel of the mobile control device. It is also provided, for security, that an identification of the user is required for actuating the control device. This can be performed through input of a user keyword and an associated password as well as by an identification at the mobile control device through finger prints or a sensor for identifying the iris of the eye of the user. It is thus ensured that only authorized personnel can operate machines which process printing materials through the use of the mobile control device.

In accordance with yet an additional feature of the invention, individual functions on the machine for processing printing materials are enabled or disabled as a function of the identification and the characteristic data saved for the user. After the successful registration of a user, he or she can only actuate the functions of a printing press personally enabled for him or her or his or her stored user profile. A different function profile can thus be assigned to different groups of persons so that particularly dangerous functions can only be performed by experienced operating personnel authorized for this purpose. It is also possible for the disabling or enabling of individual functions to be different from zone to zone. Various functionalities can thus e.g. be enabled at different printing units of a printing press which have a separate respective zone, so that the operating personnel can trigger more functions at one printing unit than at another printing unit. This can affect e.g. printing units which process a special ink that is particularly difficult to process on the printing press. It is then ensured that settings at the printing unit of the special ink can only be made by the personnel authorized for this purpose.

In accordance with again another feature of the invention, it is also possible that functionalities of all involved overlapping zones are enabled in the region of overlapping zones. In this case, the operator can operate the functions in all zones which jointly overlap and freely select them. For this purpose, it is e.g. possible to switch back and forth between individual printing units so that both neighboring printing units of an overlapping zone can be operated alternately or simultaneously.

In accordance with again a further feature of the invention, however, it can alternatively also be provided that, in the region of overlapping zones, the user is offered a selection of the involved zones and only one zone can be selected by the user and only that zone is enabled for use. This is particularly useful in the case of overlapping zones in which one includes a dangerous region so that the user must concentrate fully on operating processes of that zone. By forcing him or her to select, it is thus ensured that the user can only operate one zone with the dangerous region, e.g. delivery or feeder, without simultaneously being distracted by operating processes at other zones. Moreover, by forcing him or her to select, it is ensured that, in the case of operating processes, no confusion of functions which are present in both parts of the overlapping zones can occur when the currently operable zone is also displayed visually marked on the portable control device, so that the operator is also informed visually on the operating device as to which part of the machine he or she is currently operating. It is also possible that an optical identification device, such as red illuminating lamps which respectively light up in the selected zone at the time, is assigned to the individual zones, such as e.g. the printing units of a printing press, at the machine itself. It is thus visually signaled again to the operator at the machine itself as to which zone he or she is currently operating.

In accordance with again an added feature of the invention, the machine for processing printing materials has a plurality of mobile control devices. In this case, it must be ensured by a coordination of the respectively registered mobile control devices in the case of the machine control unit of the machine, that either only one mobile control device is active or that at least the zone is respectively disabled for one of the other operating devices which was selected by a control device as active. It is also possible to define a mobile control device as a "master" from which the other mobile control devices can be restricted in their functionality. For example, further operating devices can be restricted in their function from the "master" so that only specific zones or functions can be selected there. It is particularly useful when learning unlearned working forces if the further mobile control devices can be monitored from the "master" so that e.g. dangerous functions are only enabled under the supervision of the operator at the "master".

With the objects of the invention in view, there is also provided a printing press having the apparatus according to the invention.

With the objects of the invention in view, there is additionally provided a machine for processing printing materials. The machine comprises a plurality of spatially delimited zones and a mobile control device for safe operation of the machine for processing printing materials. The mobile control device has a position to be detected relative to the plurality of zones, for determining a zone in which the control device is located by using the position of the control device, and enabling or disabling specific functions of the machine for processing printing materials in dependence on the determined zone.

With the objects of the invention in view, there is concomitantly provided a method for safely operating a machine for processing printing materials. The method comprises dividing the machine for processing printing materials into a plurality of spatially delimited zones, detecting a position of a mobile control device relative to the plurality of zones, determining a zone in which the control device is located by using the position of the control device, and enabling or disabling specific functions of the machine for processing printing materials in dependence on the determined zone.

Other features which are considered as characteristic for the invention are set forth in the appended claims.

Although the invention is illustrated and described herein as embodied in an apparatus for operating a printing press with a plurality of operating zones, a printing press and a machine having the apparatus and a method for safely operating a machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a diagrammatic, longitudinal-sectional view of a printing press with two printing units, a feeder and a delivery, which is divided into a plurality of operating zones.

DETAILED DESCRIPTION OF THE INVENTION

Referring now in detail to the single FIGURE of the drawing, there is seen a printing press 1 that includes two printing units 2, 3, a feeder 8 and a delivery 9, which are each assigned to a respective operating zone I, II, III, IV. The printing units 2, 3 as well as the feeder 8 and the delivery 9 are controlled by a machine control unit 5. The machine control unit 5 furthermore includes a wireless interface which can be formed as a radio connection in the form of a W-LAN connection or Bluetooth connection. The machine control 5 can communicate with mobile control devices such as a correspondingly constructed notebook computer 6 through this wireless interface. The communication between the notebook computer 6 and the machine control unit 5 then takes place wirelessly through an air interface 7. A plurality of notebook computers 6 can also be wirelessly connected to the machine control unit 5. The operator can thus control the printing press 1 through the notebook computer 6 over the wireless interface 7, and make settings at the printing units 2, 3, at the feeder 8 and at the delivery 9.

The notebook computer 6 furthermore additionally includes an RFID chip 10 which continuously contains an encoded signal. As soon as the notebook computer 6 with the RFID chip 10 reaches the region of a plurality of receiving units 11 at the printing press 1, the position of the notebook computer can be assigned by a restricted range of the receivers 11 to a zone I, II, III, IV. The receiving units 11 are in turn connected to the machine control unit 5. As soon as the notebook computer 6 leaves the region of a zone again, the functions in that zone can no longer be operated from the notebook computer 6. There are overlapping regions 4 of the operating zones I to IV. In these overlapping regions 4, the notebook computer 6 is located in the range of a plurality of receivers 11. Depending on the configuration of operating software on the notebook computer 6, either both zones e.g. the zones II, III of the printing units 2, 3 can then be operated, or the operator must select a zone I, IV such as e.g. at the delivery 9 and the feeder 8. It is thus ensured that, in the region of the feeder 8 and the delivery 9, the operator must always decide on a zone so that he or she cannot be distracted during operation of the feeders 8 and the deliveries 9 including dangerous regions, by the operation of neighboring zones II, III. The notebook computer 6 is furthermore constructed in such a manner that the operator must first register at least with a keyword and associated password before use. Depending on the saved personal authorization, the operator can then perform the functions enabled for the respective person in the various operating zones I to IV at the printing press 1 after successful registration.

The invention claimed is:

1. An apparatus for safely operating machinery, the apparatus comprising:

a printing machine divided into a plurality of spatially delimited zones for processing printing materials, said printing machine having a plurality of printing units assigned together to one of said zones; and a mobile control device having a position to be detected relative to said plurality of zones, for determining a zone in which said control device is located by using said position of said control device, and enabling or disabling specific functions of said printing machine for processing printing materials in dependence on said determined zone.

2. The apparatus according to claim 1, wherein said control device includes an electronic transmitter.

3. The apparatus according to claim 2, wherein said printing machine for processing printing materials includes at least one electronic receiver and a machine control unit, said electronic transmitter of said control device transmits a signal received by said at least one electronic receiver, said machine control unit calculates said position of said control device with said signals recorded by said electronic receiver, and functions are enabled or disabled in at least a plurality of said zones in dependence on said position of said control device.

4. The apparatus according to claim 1, wherein said printing machine includes a delivery and a feeder each being assigned a respective separate one of said zones.

5. The apparatus according to claim 1, wherein said mobile control device is a portable computer with a data radio module.

6. The apparatus according to claim 1, wherein said portable computer includes an RFID chip.

7. The apparatus according to claim 1, wherein said zones at least partially overlap.

8. The apparatus according to claim 7, wherein functionalities of all involved overlapping zones are enabled in a region of overlapping zones.

9. The apparatus according to claim 7, wherein a user is offered a selection of involved zones and only one zone can be selected by the user and enabled for use, in a region of overlapping zones.

10. The apparatus according to claim 1, wherein an identification of a user is required to actuate said control device.

11. The apparatus according to claim 10, wherein individual functions of said printing machine for processing printing materials are enabled or disabled as a function of said identification and characteristic data saved for the user.

12. The apparatus according to claim 1, wherein the disabling or enabling of individual functions is different from zone to zone.

13. A machine for processing printing materials, the machine comprising:

a plurality of spatially delimited zones;

a plurality of printing units assigned together to one of said zones; and a mobile control device for safe operation of the machine for processing printing materials, said mobile control device having a position to be detected relative to said plurality of zones, for determining a zone in which said control device is located by using the position of said control device, and enabling or disabling specific functions of the machine for processing printing materials in dependence on the determined zone.

14. A method for safely operating a machine for processing printing materials, the method comprising the following steps:

dividing the machine for processing printing materials into a plurality of spatially delimited zones;

providing the machine with a plurality of printing units assigned together to one of the zones;

providing a mobile control device;

detecting a position of the control device relative to the plurality of zones;

determining a zone in which the control device is located by using the position of the control device; and enabling or disabling specific functions of the machine for processing printing materials in dependence on the determined zone.

15. The method according to claim 14, which further comprises:

transmitting a signal from an electronic transmitter of the control device to at least one electronic receiver of the machine for processing printing materials;

calculating the position of the control device from the signals recorded by the at least one electronic receiver in a machine control unit of the machine for processing printing materials; and enabling or disabling functions in at least a plurality of the zones in dependence on the position of the control device.

16. The method according to claim 14, which further comprises providing the machine for processing printing materials in the form of a printing press with a plurality of printing units, a delivery and a feeder, assigning one zone to at least one of the printing units, and assigning each of the delivery and the feeder to a separate respective zone.

17. The method according to claim 14, wherein the mobile control device is a portable computer with a data radio module or RFID chip.

18. The method according to claim 14, which further comprises requiring an identification of a user to actuate the control device, and enabling or disabling individual functions of the machine for processing printing materials as a function of the identification and characteristic data saved for the user.

19. The method according to claim 14, which further comprises carrying out the disabling or enabling of individual functions differently from zone to zone.

20. The method according to claim 14, which further comprises enabling functionalities of all involved overlapping zones in a region of overlapping zones.

21. The method according to claim 14, which further comprises offering a user a selection of involved zones in a region of overlapping zones, and permitting only one zone to be selected by the user and enabled for use.

* * * * *